US006320477B1

(12) United States Patent
Lithgow et al.

(10) Patent No.: US 6,320,477 B1
(45) Date of Patent: Nov. 20, 2001

(54) ADJUSTABLE OFF-CENTER COAXIAL COUPLER

(75) Inventors: Robert D. Lithgow, Schaumburg; Hong Gan, Vernon Hills; Miles Tusa, Crystal Lake, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/564,286

(22) Filed: May 4, 2000

(51) Int. Cl.[7] ..... H01P 5/18

(52) U.S. Cl. ..... 333/111; 333/160; 439/578; 439/675

(58) Field of Search ..... 333/111, 27, 160, 333/161; 439/578, 675

(56) References Cited

U.S. PATENT DOCUMENTS 5,382,932 1/1995 Monti ..... 333/245
5,769,662 6/1998 Stabile et al. ..... 439/578
5,945,643 8/1999 Shimirak et al. ..... 174/71
5,994,977 11/1999 Taya ..... 333/111

*Primary Examiner*—Justin P. Bettendorf
*Assistant Examiner*—Joseph Chang
(74) *Attorney, Agent, or Firm*—Douglas D. Fekete; Lalita P. Williams

(57) ABSTRACT

An energy coupler (10) includes a movably adjustable energy coupling sleeve (16), and a coupling transmission line (18) operatively coupled to the movably adjustable energy coupling sleeve (16) to provide adjustable coefficient coupling with a transmission line (14), such as a coaxial transmission line. In one embodiment, the movably adjustable energy coupling sleeve (16) is configured to rotatably move to provide selectable energy coupling with the coaxial transmission line (14).

11 Claims, 3 Drawing Sheets

ADJUSTABLE OFF-CENTER COAXIAL COUPLER

FIELD OF THE INVENTION

The invention relates generally to energy couplers and more particularly to adjustable energy couplers for coupling radio frequency energy, such as microwave energy, or any other energy, to or from a transmission line, such as a coaxial cable.

BACKGROUND OF THE INVENTION

Energy couplers are known that couple energy to or from a transmission line to allow test equipment or other analysis equipment to monitor information being communicated over transmission lines, such as coaxial cables. In addition, energy couplers are used to inject energy onto transmission lines, if desired or "splits" signals. For example, with wireless communication systems, conventional energy couplers are often connected in-line with transmission lines that are embedded in coaxial cables to determine system performance and to split signals. If couplers have low coupling coefficients, high losses can result. In addition, certain applications, such as those involving delay lines, require proper impedance matching to avoid changes in delay times. Accordingly, energy couplers should provide the ability to facilitate relatively easy impedance matching. It is desirable to minimize power losses due to energy coupling and to provide an optimized power efficiency for couplers to avoid power losses.

One known type of energy coupler, sometimes referred to as a planar strip line coupler, uses a non-adjustable planar microstrip that is connected in series with a transmission line at a terminal connection of a transmission line such as a coaxial cable. A second wire is placed in close proximity to the planar microstrip on a printed circuit board and serves as a coupling line. These planar strip line couplers typically provide a fixed coupling coefficient with the coaxial transmission line, and are typically inserted in-line (in series) with the coaxial transmission line. Such planar strip line couplers provide fixed coupling coefficients and need to be inserted, re-moved at different points along a coaxial cable, and reinserted until a suitable coupling coefficient is reached.

Another known type of energy coupler include s a two-wire coaxial coupler which typically includes two wires in a twisted pair format that are placed in-line with the coaxial cable. This configuration also provides a fixed coupling coefficient and also has to be connected in series with the coaxial cable transmission line. Such two wire coaxial couplers may be physically cut in different length to provide a different fixed coupling coefficient. However, such length adjustment can become cumbersome.

In addition, other energy couplers are known that may provide a pin that may be manually adjusted so that its distance varies with respect to the coaxial transmission line to change the coupling coefficient. However, the pins can be difficult to manually adjust and may not provide a suitable range of differing coupling coefficients.

Accordingly, a need exists for an energy coupler that is relatively inexpensive and compact in size that provides an adjustable coupling coefficient.

DETAILED DESCRIPTION OF THE PREFERRED EMBODIMENT

Figures 1, 2, 3:
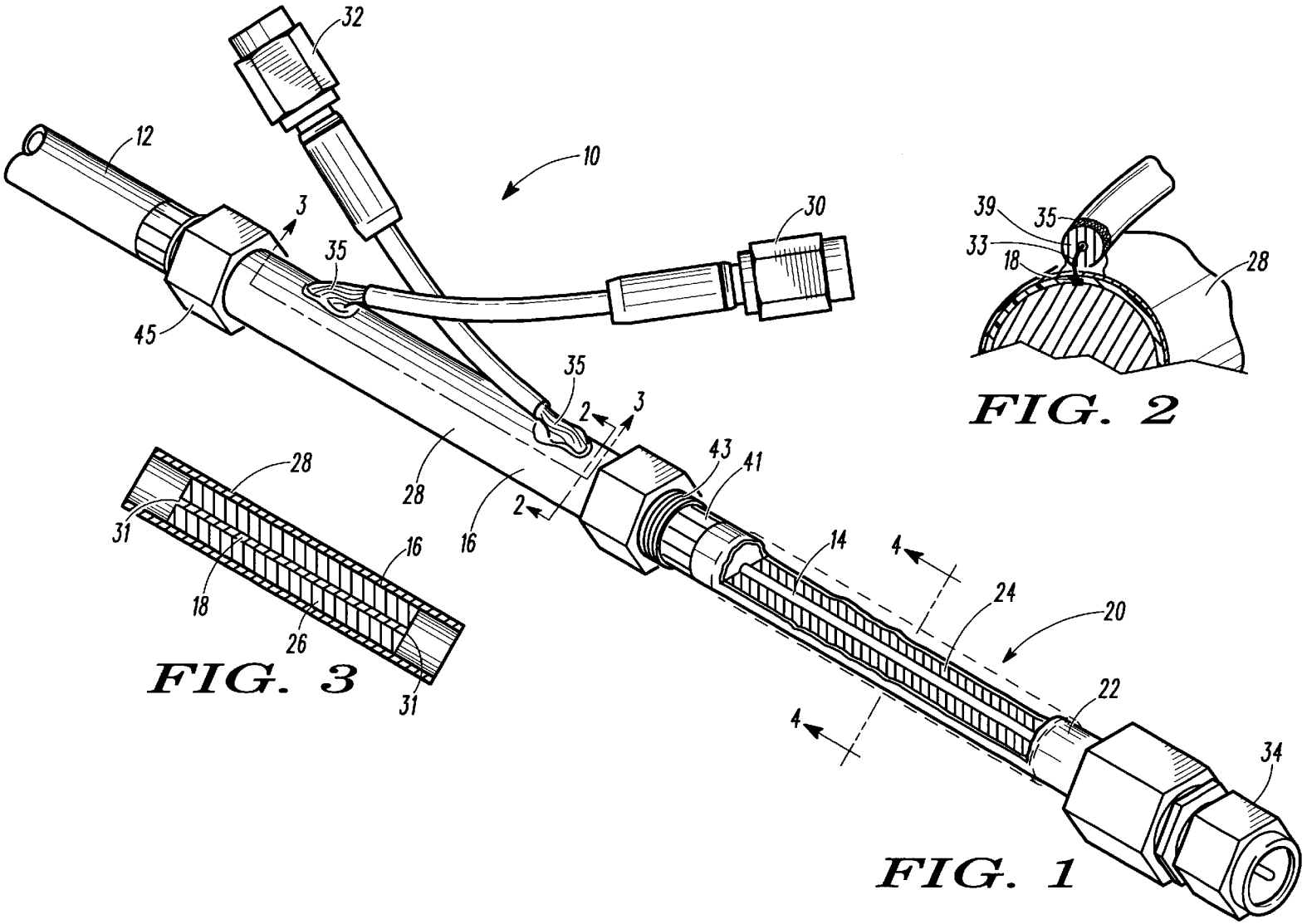
FIG. 1 is a perspective view illustrating one example of an adjustable energy coupler for a coaxial cable transmission line in accordance with one embodiment of the invention.
FIG. 2 is a partial cross-sectional view of a portion of FIG. 1.
FIG. 3 is a partial cross-sectional view of the adjustable energy coupler shown in FIG. 1.

Briefly, an energy coupler includes a movably adjustable energy coupling sleeve, and a coupling transmission line operatively coupled to the movably adjustable energy coupling sleeve to provide adjustable coefficient coupling with a transmission line, such as a coaxial transmission line. In one embodiment, the movably adjustable energy coupling sleeve is configured to rotatably move to provide selectable energy coupling with the coaxial transmission line.

In one embodiment, the movably adjustable energy coupling sleeve includes a dielectric sleeve and an outer shield. The coupling transmission line, such as a microstrip line or cylindrical wire, or any other suitable coupling transmission line, is operatively coupled to the sleeve. In one example, the coupling transmission line is disposed on an inner surface of the dielectric sleeve. In another embodiment, the coupling transmission line is disposed within the dielectric material of the dielectric sleeve. The movably adjustable energy coupling sleeve also includes at least one terminal that is electrically coupled to the coupling transmission line. The energy coupler may also include compression fittings at either end of the sleeve to operably attach to a coaxial cable, or other transmission line source. The energy coupler couples high frequency energy from a portion of a transmission line, such as a portion of the coaxial cable. In one embodiment, the energy coupler serves as a coaxial coupler assembly that includes a section of teflon dielectric with an internal microstrip line and an external ground shield around the teflon dielectric. The coupler assembly is positioned, for example, in a coaxial cable section where a portion of ground shield of the coaxial cable and the dielectric of the coaxial cable have been removed such that high frequency energy can be coupled to the energy coupler assembly and out to various circuitry. The energy coupler offers a simple, relatively low cost adjustable energy coupler that can reduce the costs of delay assemblies. The variable coupling coefficient adjustment can result in lower insertion loss. In addition, the adjustable coupling can compensate for gain variations of other circuits.

The movably adjustable energy coupling sleeve may be any suitable shape, such as a circular cross section, a square cross section, or any other suitable shape to accommodate adjustable energy coupling with a desired transmission line.

Also, in another embodiment, a coaxial cable includes a transmission line, dielectric material surrounding at least a portion of transmission line, and a shield that is coaxial with the transmission line. The shield has an opening formed therein. The coaxial cable also includes an energy coupler disposed about the coaxial cable that is located proximate to the opening and includes the movably adjustable energy coupling sleeve and corresponding coupling transmission line.

In another embodiment, a coaxial cable includes a portion having an off-center transmission line wherein the energy coupler is rotatable about the portion having an off-center transmission line to effect changes in coupling coefficients based on changes in distance between the coupling transmission line and the off center transmission line in the coaxial cable.

In yet another embodiment, a method for forming an energy coupler includes forming a sleeve of dielectric material wherein the sleeve has an inner surface and an outer surface. The outer surface is formed with an outer shield containing electrically conductive material, such as a copper shield or leaded sheath. The method further includes forming a coupling transmission line on an inner surface of the sleeve wherein the coupling transmission line is formed of an electrically conductive material.

FIGS. 1–3 illustrate one example of an energy coupler 10 positioned about a transmission line source, such as a coaxial cable 12 containing a transmission line 14 that conducts radio frequency (RF) energy, including microwave energy, or any other suitable energy. The energy coupler 10 includes a movably adjustable energy coupling sleeve 16 and a coupling transmission line 18 that is operatively coupled to the movably adjustable energy coupling sleeve 16. For purposes of illustration, the movably adjustable energy coupling sleeve 16 is shown to be located on a portion of the coaxial cable 12 that still includes an outer shield 22. However, in practice, the movably adjustable energy coupling sleeve 16 is positioned over an opening 20 in a portion of the coaxial cable 12. The dashed lines of FIG. 1 represent a location of the energy coupler 10 when it is properly positioned as an adjustable energy coupler. The opening 20 may be formed by suitably cutting and removing the outer shield 22 and portion of internal dielectric 24 from the coaxial cable 12. This allows air to serve as the dielectric between the transmission line 14 and the coupling transmission line 18 when the adjustable energy coupling sleeve 10 is positioned over the opening 20.

The movably adjustable energy coupling sleeve 16 includes a dielectric sleeve 26 and an outer shield 28. The dielectric sleeve 26 may be made of polytetrafluoroethylene (teflon) or any other suitable dielectric material. The outer shield 28 of the movably adjustable energy coupling sleeve 16 may structurally support a first terminal 30 and a second terminal 32 wherein the first and second terminals 30 and 32 are electrically coupled to the coupling transmission line 18 through any suitable mechanism. As shown in FIG. 2, in this example, an internal conductor 33 (see FIG. 2) of the first and second terminals 30, 32 is soldered to the coupling transmission line 18 that is passed through orifices 31 in the outer shield 28. However, any suitable connection may be used. When securing the energy coupler, the coupling transmission line should be isolated from an outer surface of the sleeve and the outer surface of the coaxial cable. In addition, a grounding sheath 35 of the terminals 30 and 32 is electrically coupled to the outer shield 28. An insulating layer 39 isolates the internal conductor 33 from the grounding sheath 35. The first and second terminals 30 and 32 may be any conventional couplers, such as coaxial cable with terminating connectors on distal ends thereof. The terminals 30 and 32 may be operatively coupled to any transceiver, other couplers or any other suitable process or device. The coaxial cable 12 may further include a terminating resistor. In addition, one of the terminals 30 or 32 may also be terminated by a terminating resistor, and the other terminal may be operatively connected to a transceiver or other coupler or other transmission lines, as desired.

The movably adjustable energy coupling sleeve 16 is configured to rotatably move with respect to the transmission line 14 to provide selectable energy coupling with the transmission line 14. The movably adjustable energy coupling sleeve 16 is adjustable in a rotatable relationship with respect to the coaxial cable 12. In addition, if desired, the movably adjustable energy coupling sleeve 16 is configured to slidably move along the axis of the transmission line 14 to provide additional selectable energy coupling with the transmission line 14.

If desired, the movably adjustable energy coupling sleeve 16 may have a length that exceeds the length of the coupling transmission line 18 so that when the adjustable energy coupling sleeve 10 is positioned over the opening 20, energy is unable to readily radiate from distal ends of the movably adjustable energy coupling sleeve 16. However, it will be recognized that any suitable length of coupling transmission line 18 and length of the movably adjustable energy coupling sleeve may also be used.

The energy coupler 10 may also include, if desired, an attachment member on both distal ends of the movably adjustable energy coupling sleeve 16 which form a compression fitting that forms a compression fit with the outer shield 22 of the coaxial cable 12. In this example, the energy coupler includes compressable segments 41 (see FIG. 1) on distal ends thereof and threads 43 adjacent thereto. A compression nut 45 (shown on only one distal end for clarity) engages the threads 43 and compresses the compressable segments 41 to form a compression fit with the outer shield of the coaxial cable so that energy is not lost between air gaps of the movable adjustable coupling sleeve and an outer surface or opening of the coaxial cable. Alternative attachment members, such as single attachment members, or soldering the distal ends with a solder alloy or the other suitable portion of the movably adjustable energy coupling sleeve 16 may also be used.

The outer shield 22 of the coaxial cable 12 is coaxial with the transmission line 14. The outer shield 22 has the opening 20 therein. In operation, the energy coupler 10 is disposed about the coaxial cable 12 proximal to the opening 20 to effectively cover the opening 20. The coaxial cable 12 may be a semi-rigid coaxial cable, such as a braided shield as is known in the art. Alternatively, the outer shield 22 of a coaxial cable may be formed of a rigid metallic material, such as copper or copper alloy. Alternatively, the outer shield 22 may be formed of aluminum or any other suitable metal or material with a metallized inner or outer surface or composite containing suitable shielding material. The coaxial cable 12 may have a terminal connector 34, as known in the art, to operatively connect with an energy source, an energy receiver, or other coaxial cable. As known in the art, the transmission line 14 may be a centered solid conductor, or a plurality of twisted conductors or any other suitable transmission line.

Figure 4:
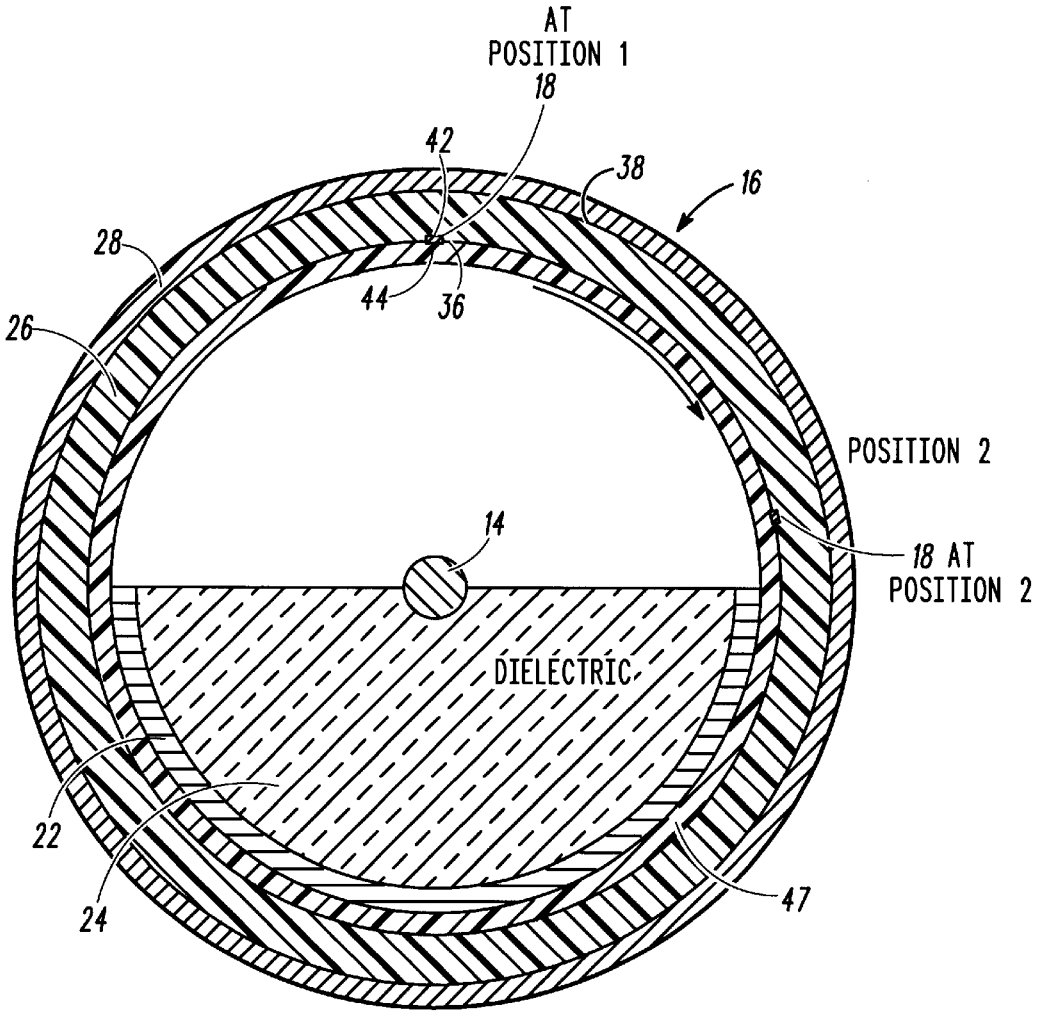
FIG. 4 is a cross-sectional view showing an interior of an adjustable energy coupler positioned with respect to a coaxial transmission line.

FIG. 4 illustrates a cross-sectional view of the energy coupler 10 positioned over the opening 20 shown in FIG. 1. As shown, the movably adjustable energy coupling sleeve 16 includes an inner surface 36 and an outer surface 38 opposite the inner surface 36. The outer shield 28 is disposed on the outer surface 38 of the movably adjustable energy coupling sleeve 16. The coupling transmission line 18, in this embodiment, is operatively disposed on the inner surface 36 of the movably adjustable energy coupling sleeve 16. The coupling transmission line 18 is shown to be a microstrip having a substantially rectangular cross section, although any suitable type of transmission line may be used. The coupling transmission line 18 has a transmission line inner surface 42. The transmission line inner surface 42 and the inner surface 36 of the movably adjustable energy coupling sleeve 16 are abutting surfaces. As shown, the coupling transmission line 18 has an outer surface 44 that is shown to be exposed such that no dielectric material covers the outer surface 44 of the coupling transmission line 18. However, if desired, the microstrip may be inserted within the dielectric material forming the sleeve. In addition, if desired, an insulating sleeve 47 such as a Teflon sleeve, may be inserted between the energy coupling sleeve 16 and the outer shield 22.

In addition, all of the inner dielectric in the coaxial cable may be removed, if desired, to allow only air to be between the movably adjustable energy coupler and the transmission line.

The coupling transmission line may be made of any suitable electrically conductive material, such as copper, copper alloy, or any other suitable material. The dielectric sleeve 26 may be formed of any suitable dielectric material and is preferably formed of polytetrafluoroethylene (Teflon). However, any suitable dielectric material may be used. For example, the dielectric material may be formed of magnesium oxide or other suitable material.

If desired, for use with conventional coaxial cable, the energy coupler 10 may be slid over the outer shield 22 from an end of the coax cable 12. Also if desired, the energy coupler may include a slit along an axis thereof to form a clamshell configuration. To insert the energy coupler on a suitable portion of the coaxial cable, the energy coupler is bent open and suitably positioned. When suitably positioned, the energy coupler is closed and clamped in place using conventional clamps or any suitable securing mechanism.

In operation, the movably adjustable energy coupling sleeve 16 may be rotated, for example, to position 1, which provides the maximum coupling coefficient with the transmission line 14. As the movably adjustably energy coupling sleeve 16 is rotated from position 1 to position 2, the metallic outer shield 22 of the coaxial cable 12 which serves as a ground reference, and reduces the coupling. Accordingly, a lower coupling coefficient will result at position 2 compared with the coupling transmission line 18 being positioned at position 1. As shown in FIG. 1, the inner dielectric 24 of the coaxial cable 12 has been removed to expose a portion of the transmission line 14. In this embodiment, a full one-half of the inner dielectric 24 surrounding transmission line 14 has been removed. However, it will be recognized that a smaller portion may also be removed, if desired. In addition, it will be recognized that although air is left in the opening, another dielectric having a lower dielectric constant than the inner dielectric 24 may also be inserted in place of the removed inner dielectric 24.

The coupling transmission line 18 shown in FIG. 4 as a microstrip, may be formed as a non-planar or cylindrical conductor. The microstrip may be adhered to the dielectric sleeve 26 through any suitable mechanism, such as adhesive or plating, or any other suitable mechanism.

The energy coupler 10 may be formed, for example, by forming a sleeve of dielectric material to form the dielectric sleeve 26. The outer surface 38 of the dielectric sleeve may be operatively coupled with the outer shield 28 through a conventional plating process or any other attachment process. The outer shield 28 is formed of an electrically conductive material. The method of forming the energy coupler also includes forming the coupling transmission line 18 on the inner surface 36 of the dielectric sleeve 26 wherein the coupling transmission line 18 is formed of an electrically conductive material. The forming of the coupling transmission line 18 may include, for example, plating the inner surface 36 of the dielectric sleeve 26 with an inner conductive layer. The inner conductive layer is formed of an electrically conductive material. The forming of the coupling transmission line 18 also includes removing a portion of the inner conductive layer to form the coupling transmission line 18. In addition, the coupling transmission line may be formed by, prior to coating the inner surface, forming a channel in the sleeve wherein the inner conductive layer fills the channel. The method further includes removing a portion of the inner conductive layer that is not in the channel. Hence, the forming of the coupling transmission line, is performed by plating the dielectric after a recess (e.g., channel) has been formed in the dielectric sleeve, and removing those portions of the conductive material that do not define the microstrip. However, any suitable technique may also be used.

Figure 5:
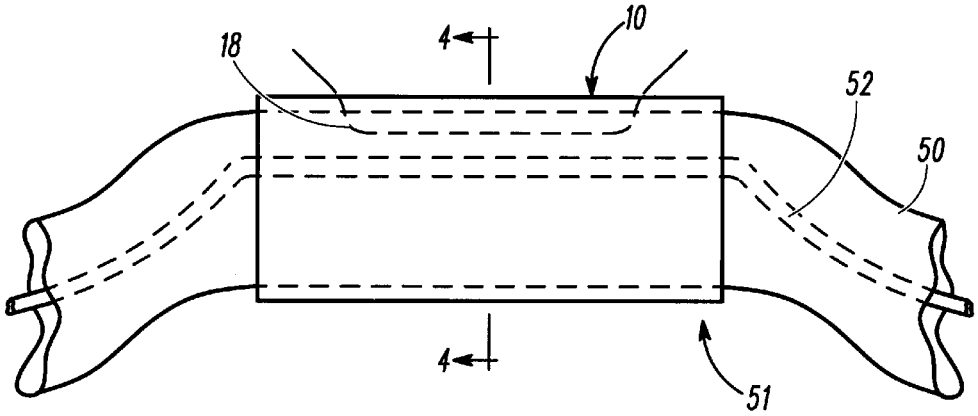
FIG. 5 is an example of an alternative embodiment of an adjustable energy coupler and coaxial cable configuration in accordance with one embodiment of the invention.
Figure 6:
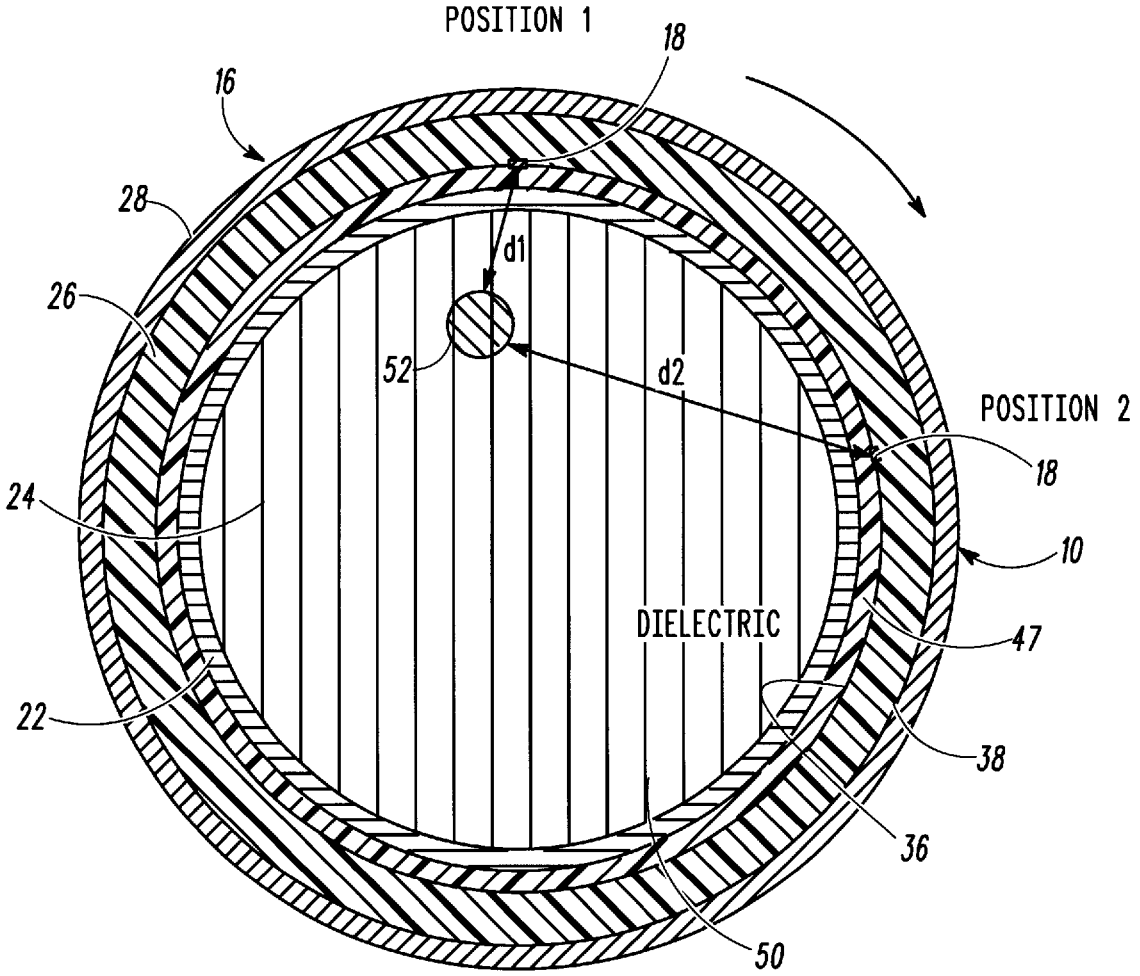
FIG. 6 is a cross-sectional view of the adjustable energy coupler shown in FIG. 5.

FIGS. 5 and 6 show an alternative embodiment of a coaxial cable and corresponding energy coupler. The coaxial cable 50 has a portion 51 having an off-center transmission line 52. The energy coupler 10 is rotatable about the portion 51 having an off-center transmission line 52. As the energy coupler 10 is rotated, the distance between the coupling transmission line 18 and the off-center transmission line 52 varies, thereby providing a variable distance and adjusting the coupling coefficient as the rotational energy coupler 10 rotates. Accordingly, coaxial cables may be pre-formed with portion 51 having off-center transmission lines to facilitate adjustable energy coupling at those portions using a movably adjustable energy coupler as described herein.

As with the embodiment in FIGS. 1–4, after a suitable position for providing a desired coupling coefficient, the energy coupler 10 may be secured in a final position by soldering the outer sleeve to an outer surface of the coaxial cable or through a compression sleeve or a plurality of compression sleeves or any other suitable attachment mechanism, if desired.

As disclosed herein, the adjusting of the coupling coefficient is independent of the port impedance and directivity. The energy coupling configuration disclosed herein provides optimized directivity by allowing rotational adjustment so that the return loss and isolation are minimized and the coupling coefficient is maximized in a given frequency band. The disclosed movably adjustable energy coupler may find many uses. For example, it may be used in a cellular radiotelephone site, within a multitone amplifier in a delay line, or in any other suitable application.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. A coaxial cable comprising:

a coaxial cable including a transmission line, a portion having an off center transmission line, dielectric material surrounding at least a portion of the transmission line, and a shield that is coaxial with the transmission line, the shield having an opening formed therein; and an energy coupler disposed about the coaxial cable proximal to the opening and including a dielectric sleeve, a coupling transmission line operatively coupled with the dielectric sleeve, an outer shield, and at least one terminal that is electrically coupled to the coupling transmission line;

wherein the sleeve is rotatable about the portion to provide a variable distance between the coupling transmission line and the off center transmission line.

2. The coaxial cable of claim 1, the energy complex further comprising a second terminal.

3. The coaxial cable of claim. 1, the energy complex further comprising a terminating resistor.

4. The coaxial cable of claim 1, wherein the energy complex is a semi-rigid coaxial cable.

5. The coaxial cable of claim 1, wherein the outer shield is formed of a metallic material.

6. The coaxial cable of claim 1, wherein the outer shield is formed of copper or a copper alloy.

7. The coaxial cable of claim 1, wherein the outer shield is formed of aluminum.

8. The coaxial cable of claim 1, wherein the energy coupler is attached to the coaxial cable with at least one compression fitting.

9. The coaxial cable of claim 1, wherein the coupling transmission line is formed of copper or a copper alloy.

10. The coaxial cable of claim 1, wherein the dielectric material is formed of polytetrafluoroethylene.

11. The coaxial cable of claim 1, wherein the dielectric material is formed of magnesium oxide.

* * * * *

UNITED STATES PATENT AND TRADEMARK OFFICE

CERTIFICATE OF CORRECTION

PATENT NO. : 6,320,477 B1
DATED : November 20, 2001
INVENTOR(S) : Lithgow et al.

It is certified that error appears in the above-identified patent and that said Letters Patent is hereby corrected as shown below:

Column 7,
Line 8, reads “complex”, should be -- coupler --
Line 10, reads “complex”, should be -- coupler --
Line 13, reads “complex”, should be -- coupler --

Signed and Sealed this

Third Day of September, 2002

*Attest:*

*Attesting Officer*

JAMES E. ROGAN
*Director of the United States Patent and Trademark Office*